US006726169B1

(12) United States Patent
Tseng

(10) Patent No.: US 6,726,169 B1
(45) Date of Patent: Apr. 27, 2004

(54) SUSPENSION ASSEMBLY FOR A CEILING FAN

(76) Inventor: Ming-Chi Tseng, No. 18, Chen Hsing Tung Street, Wu Feng Hsiang, Taichung Hsien (TW)

( * ) Notice: Subject to any disclaimer, the term of this patent is extended or adjusted under 35 U.S.C. 154(b) by 38 days.

(21) Appl. No.: 10/389,945

(22) Filed: Mar. 18, 2003

(51) Int. Cl.[7] ..... B42F 13/00
(52) U.S. Cl. ..... 248/343
(58) Field of Search ..... 248/343, 298.1, 248/288.31, 292.12, 292.13, 342, 344; 416/5, 244 R, 246

(56) References Cited

U.S. PATENT DOCUMENTS 5,090,654 A * 2/1992 Ridings et al. ..... 248/343
5,303,894 A * 4/1994 Deschamps et al. ..... 248/343
5,507,619 A * 4/1996 Ryan ..... 416/5
5,613,832 A * 3/1997 Su ..... 416/244 R
6,042,072 A * 3/2000 Chi-Nan ..... 248/343
6,139,279 A * 10/2000 Pearce et al. ..... 416/244 R
6,146,191 A * 11/2000 Kerr et al. ..... 439/537
6,171,061 B1 * 1/2001 Hsu ..... 416/244 R
6,200,099 B1 * 3/2001 Liao ..... 416/244 R
6,210,117 B1 * 4/2001 Bucher et al. ..... 416/210 R
6,352,411 B1 * 3/2002 Bucher et al. ..... 416/210 R
2001/0022937 A1 * 9/2001 Bucher et al. ..... 416/244 R
2002/0081107 A1 * 6/2002 Reiker ..... 392/364

* cited by examiner

*Primary Examiner*—Leslie A. Braun
*Assistant Examiner*—Kofi Schulterbrandt
(74) *Attorney, Agent, or Firm*—Rosenberg, Klein & Lee

(57) ABSTRACT

A fixing assembly for a ceiling fan includes a main frame secured on the ceiling and having a bracket downward extending from the main frame. The bracket is provided to hold a motor of the ceiling fan in place. A housing is connected to the main frame for covering the motor of the ceiling fan. At least one pushing device is partially and slidably received in one end of the main frame to push an inner periphery of the housing for holding the housing in place.

8 Claims, 13 Drawing Sheets

SUSPENSION ASSEMBLY FOR A CEILING FAN

BACKGROUND OF THE INVENTION

1. Field of the Invention

The present invention relates to a suspension assembly, and more particularly to a suspension assembly for a ceiling fan.

2. Description of Related Art

A conventional suspension assembly for a ceiling fan in accordance with the prior art shown in FIGS. 12 and 13 comprises a bracket (6) adapted to be secured on the ceiling, a housing (8) attached to the bracket (6).

The bracket (6) includes two protrusions (61) respectively downward extending from two opposite ends of the bracket (6). A socket (62) is centrally formed in the bracket (6) and a through hole (63) is centrally defined in a bottom of the socket (62).

The size of the bracket (6) is fixed such that the size of the housing (8) must correspond to that of the bracket (6). The housing (8) is attached to the bracket (6) by bolts (not numbered) that are extending through the housing (8) and the protrusions (61) of the bracket (6). Consequently, the housing (8) may not be suitably mounted to the bracket (6) due to a manufacturing error of size or different standards. Furthermore, to screw the bolts for mounting the housing (8) to the bracket (6) is an inconvenient work to a person who like DIY.

The present invention has arisen to mitigate and/or obviate the disadvantages of the conventional suspension assembly for a ceiling fan.

SUMMARY OF THE INVENTION

The main objective of the present invention is to provide an improved suspension assembly for a ceiling fan.

To achieve the objective, the suspension assembly in accordance with the present invention comprises a main frame secured on the ceiling and having a bracket downward extending from the main frame. The bracket is provided to hold a motor of the ceiling fan in place. A housing is connected to the main frame for covering the motor of the ceiling fan. At least one pushing device is partially and slidably received in one end of the main frame to push an inner periphery of the housing for holding the housing in place.

Further benefits and advantages of the present invention will become apparent after a careful reading of the detailed description with appropriate reference to the accompanying drawings.

DETAILED DESCRIPTION OF THE INVENTION

Figure 1:
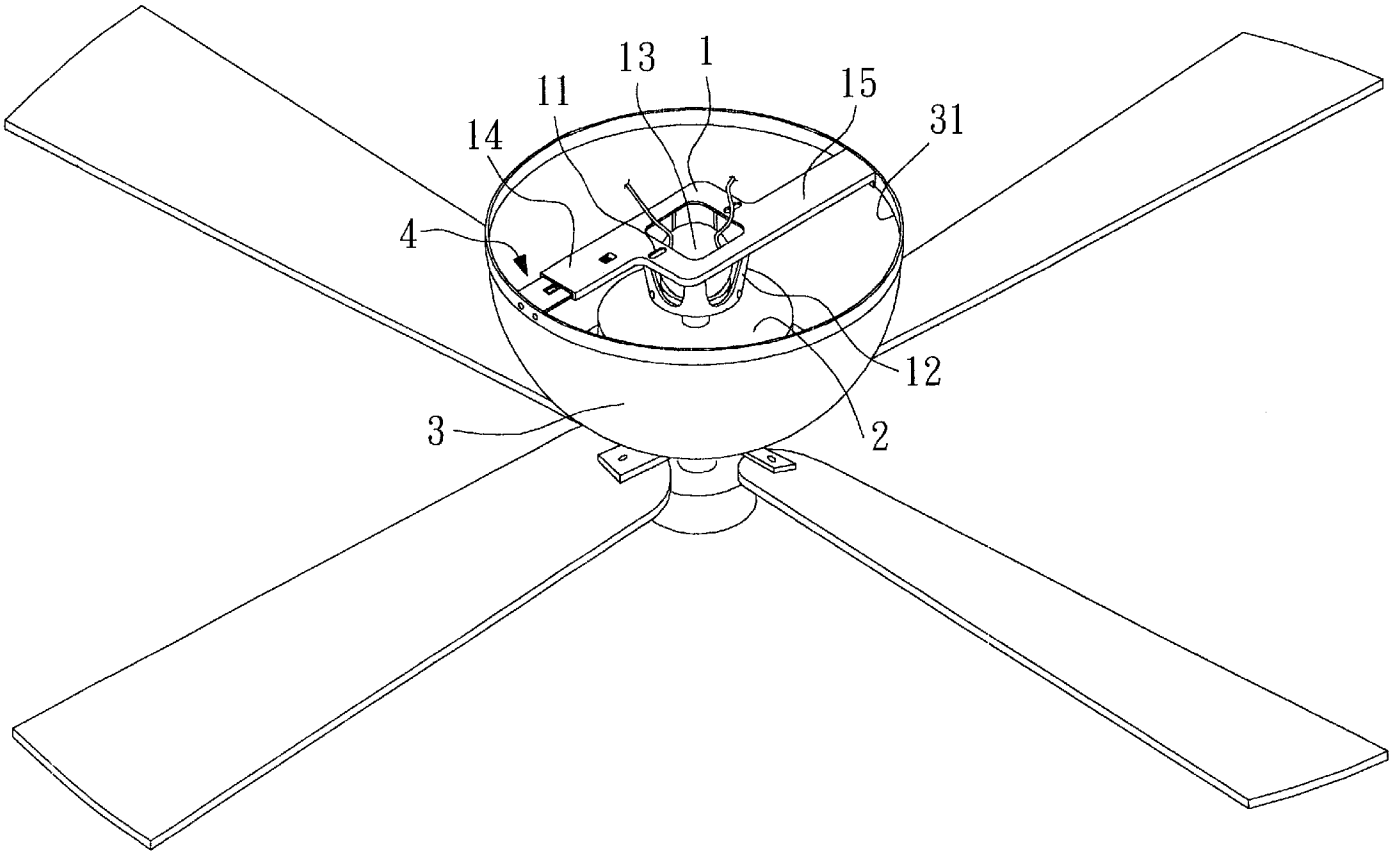
FIG. 1 is a perspective schematic view of a suspension assembly for a ceiling fan in accordance with the present invention.
Figure 2:
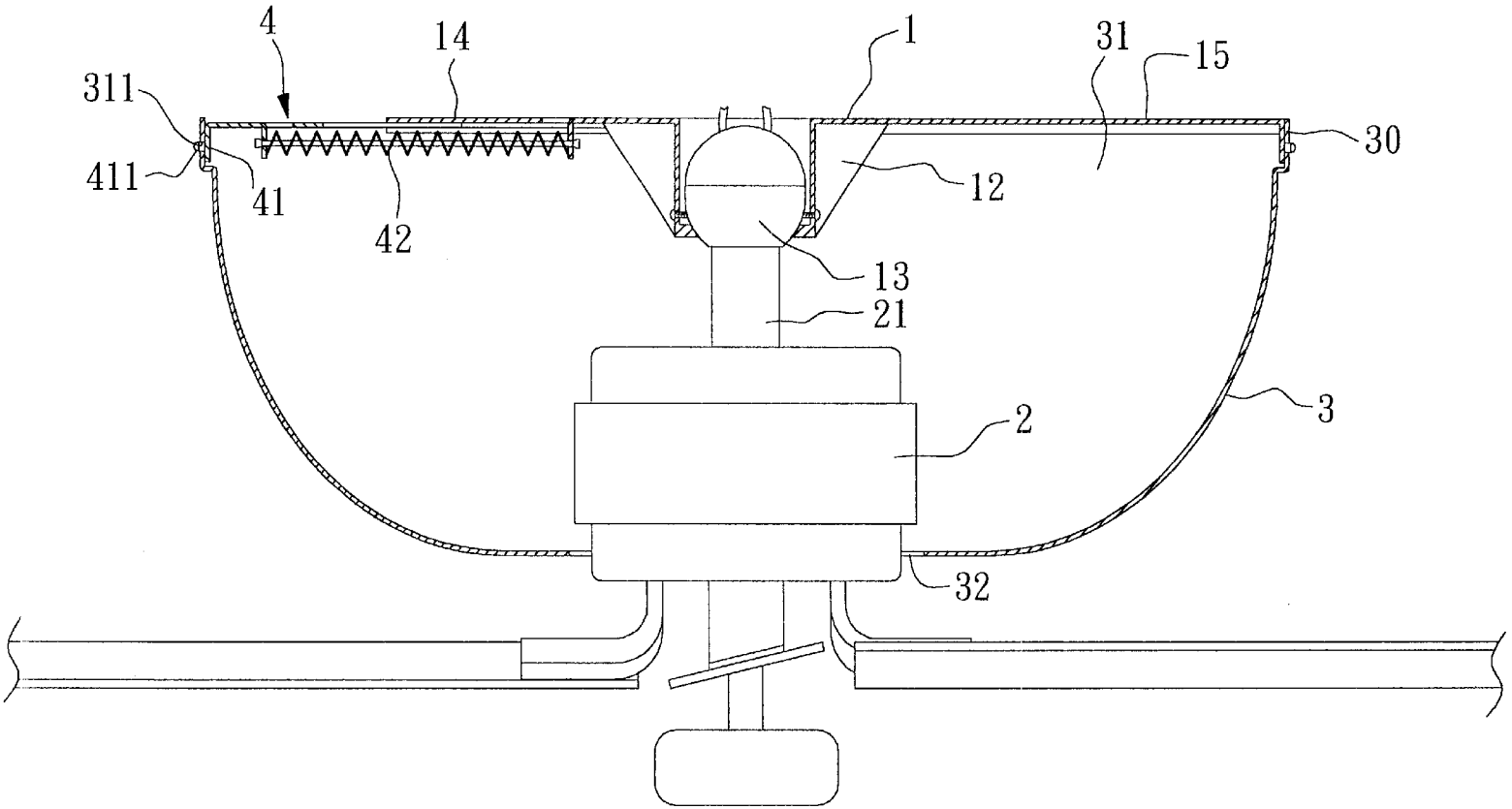
FIG. 2 is a schematic side plan view of the suspension assembly in FIG. 1.
Figure 3:
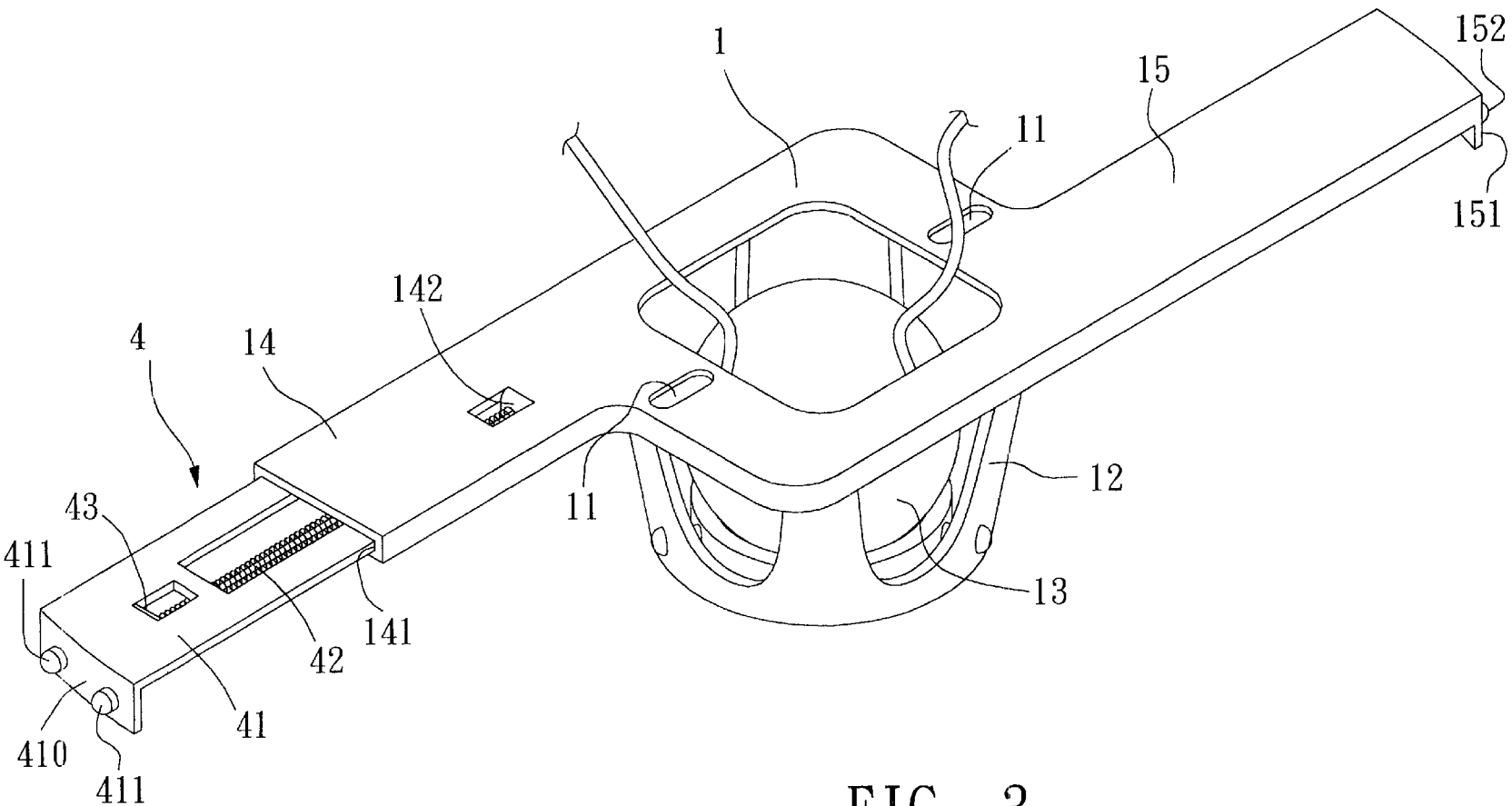
FIG. 3 is a perspective view of a bracket of the suspension assembly for a ceiling fan in FIG. 1.
Figure 4:
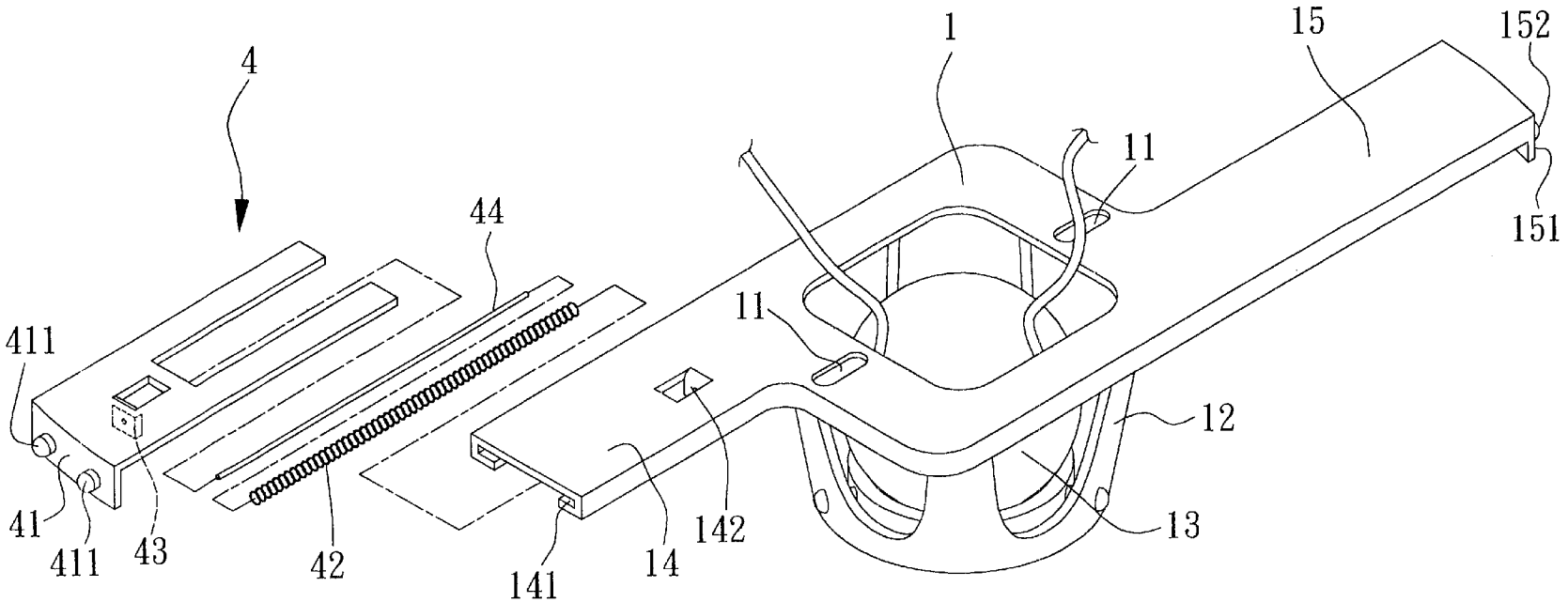
FIG. 4 is an exploded perspective view of the bracket in FIG. 3.
Figure 5:
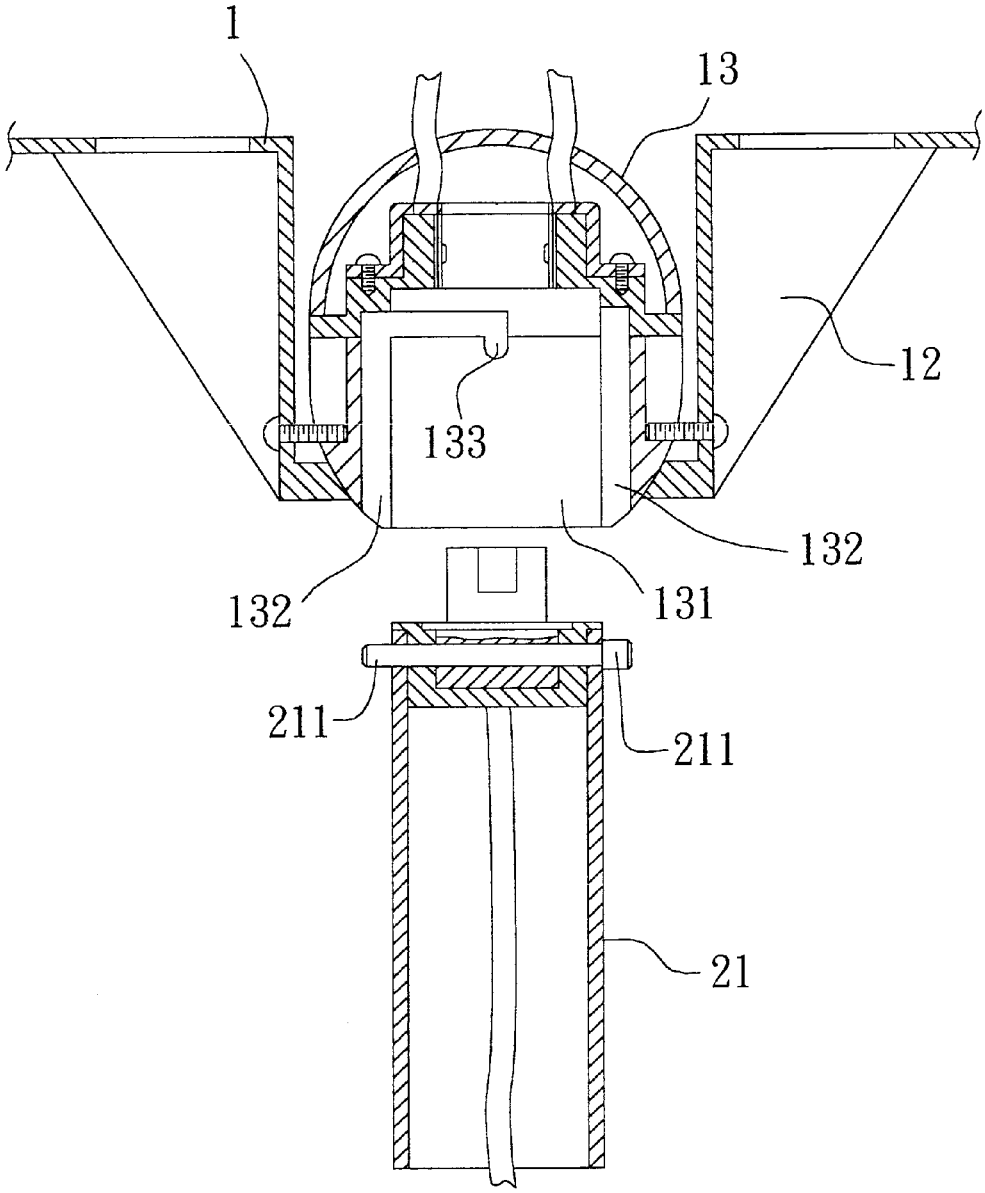
FIG. 5 is an operational side plan view of the bracket in FIG. 3.
Figure 6:
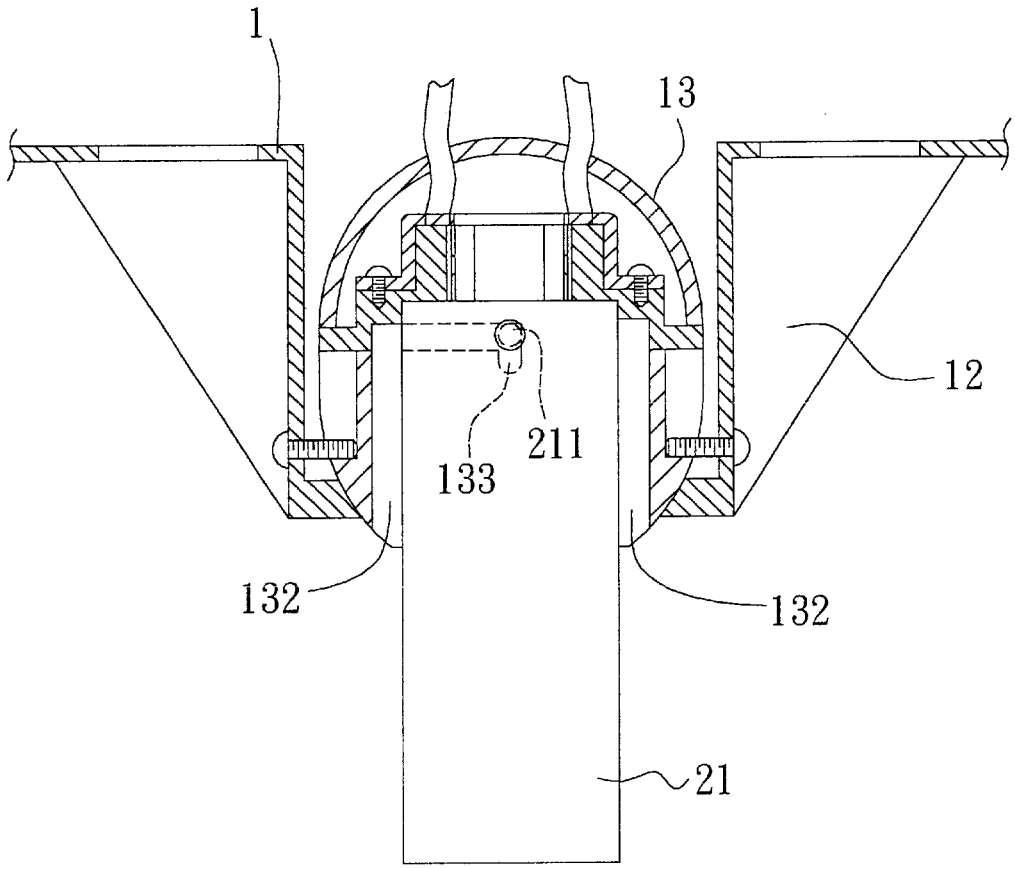
FIG. 6 is a schematic side plan view of the bracket in FIG. 3.

Referring to the drawings and initially to FIGS. 1–5, a suspension assembly for a ceiling fan in accordance with the present invention comprises a main frame (1) adapted to be secured on a ceiling and connected to a motor (2) of the ceiling fan, and a housing (3) attached to the main frame (1).

The main frame (1) comprises multiple through holes (11) defined in the main frame (1) for allowing bolts (not shown) extending through the main frame (1) and being screwed into the ceiling to hold the main frame (1) in place on the ceiling. A bracket (12) downward extends from the main frame (1). A suspension seat (13) is secured in the bracket (12) for connected to the motor (2) of the ceiling fan. A cavity (131) is defined in the suspension seat (13). The cavity (131) has a lower open end and an upper close end. The cavity (131) is adapted to receive a suspension shaft (21) of the motor (2). The suspension seat (13) has two grooves (132) longitudinally defined in a periphery of the cavity (131). The two grooves (132) are inverted L-shaped and diametrically correspond to each other. Each groove (132) has a first end extending to an outer periphery of the suspension seat (13) and a second end. An indentation (133) is defined in the second end of each of the groove (133). Each indentation (133) communicates with a corresponding one of the grooves (132) and extends toward the lower open end of the cavity (131).

The suspension shaft (21) has two protrusions (211) extending from a free end of the suspension shaft (21) and diametrically corresponding to each other. The two protrusions (211) are moved in the two grooves (132) in the suspension seat (13) when the free end of the suspension shaft (21) is inserted into the cavity (131). The suspension shaft (21) is turned to make the two protrusions (211) respectively received in a corresponding one of the two indentations (133) in the suspension seat (13) such that the motor (2) is hung, on the suspension seat (13).

The housing (3) has an upper opening (31) defined therein and a lower opening (32) defined to longitudinally correspond to the upper opening (31) in the housing (3). The lower opening (32) allows the suspension shaft (21) extending into the cavity (131) in the suspension seat (13). The housing (3) has a skirt (30) extending therefrom and defining the upper opening (31). The housing (3) includes multiple through holes (311) defined in the skirt (30) of the housing (3).

The main frame (1) has a first wind (14) and a second wing (15) respectively horizontally extending from the main frame (1) the first wing (14) and the second wing (15) are opposite to each other. The first wing (14) has a sliding groove (141) longitudinally defined therein for partially receiving a pushing device (4) and a stopper (142) extending into the sliding groove (141). The second wing (15) has a tongue (151) extending from a free end of the second wind (15) and facing the skirt (30) of the housing (3). Further with reference to FIG. 7, the tongue (151) has at least one stub (152) extending therefrom and received in a corresponding one of the through holes (311) when the housing (3) is attached to the main frame (1). In the preferred embodiment of the present invention, the tongue (151) has two stubs (152) extending therefrom.

The pushing device (4) includes a plate (41) having a first end reciprocally slidably received in the sliding groove (141) in the first wing of the main frame (1), and a second end having a tongue (410) extending from the plate (41) and facing the skirt (30) of the skirt (3). The tongue (410) of the plate (41) has at least one stub (411) extending therefrom and respectively received in a corresponding one of the through holes (311) in the skirt (30) of the housing (3) when the housing (3) is attached to the main frame (1). The plate (41) has a stopper (43) extending therefrom and aligning with the stopper (142) of the first wing (14). A resilient member (42) is compressively mounted between the stoppers (142, 43) of the first wing (14) and the plate (41). The resilient member (42) has two opposite ends respectively abutting the two stoppers (142, 43) of the first wing (14) and the plate (41) for providing a restitution force after the plate (41) is pushed toward the second wing (15). The pushing device (4) includes a stick (44) extending through the resilient member (42) and movably mounted on the stoppers (141, 43) of the first wing (14) and the plate (41) to prevent the resilient member (42) from becoming deformed when being compressed. In the preferred embodiment of the present invention, the resilient member (42) is a spring.

Figure 7:
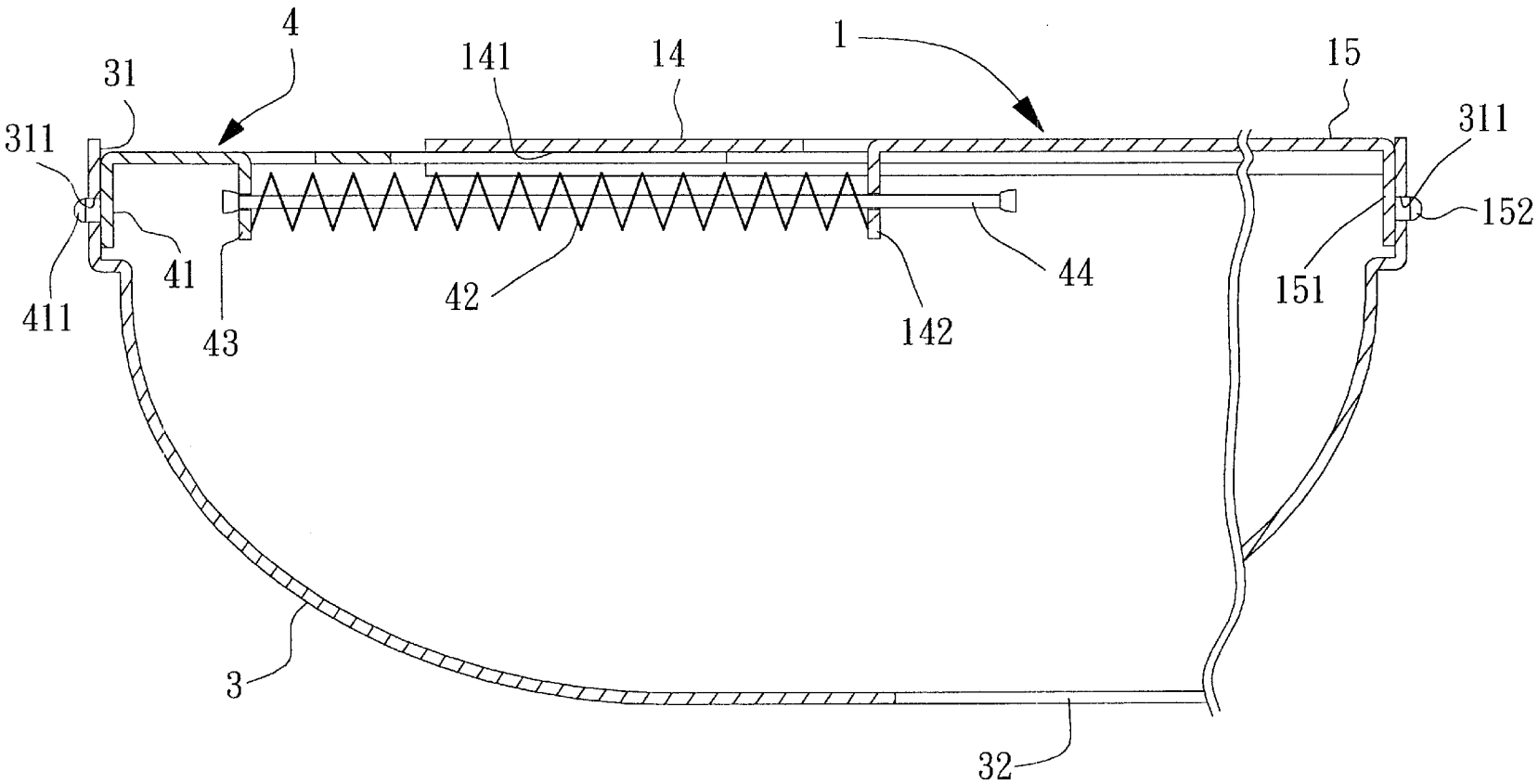
FIG. 7 is a schematic side plan view of the bracket in FIG. 3 for showing how a housing attached to the bracket.
Figure 8:
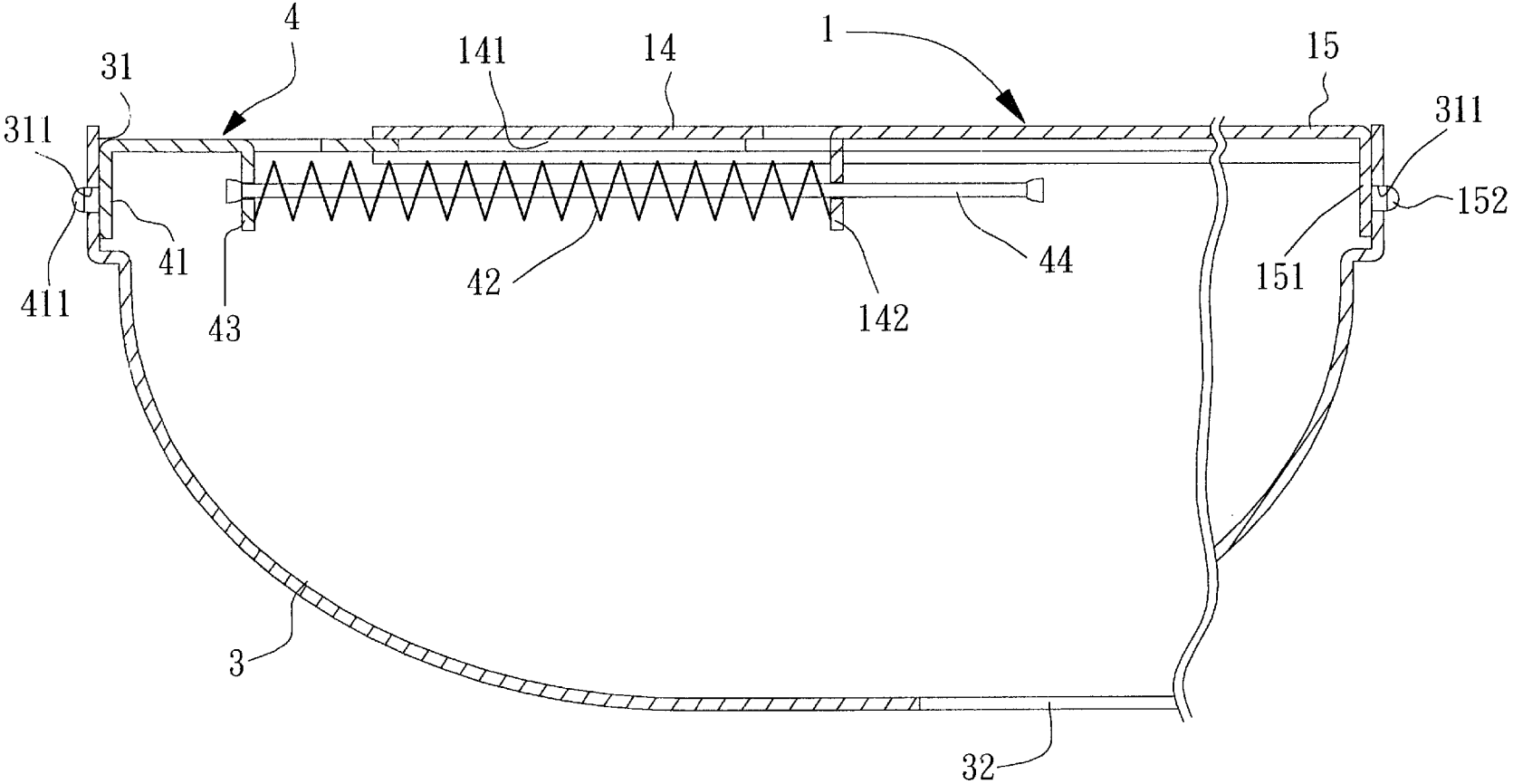
FIG. 8 is another schematic side plan view of the bracket in FIG. 3 for showing how a housing attached to the bracket.

With reference to FIGS. 7 and 8, when mounting the housing (3) to the main frame (1), the plate (41) of the pushing device (4) is previously inwardly pushed for shortening the total length of the main frame (1) and the pushing device (4). The stub (152) of the tongue (151) of the second wing (15) into the through hole (311) of the housing (3) and the plate (41) of the pushing device (4) is released when the housing (3) is moved to contain the main frame (1) and the pushing device (4) and the stub (411) of the tongue (410) of the first wing, (14) is moved and inserted into the through hole (311) of the housing (3) due to the restitution force of he resilient member (42).

As described the total length of the main frame (1) and the pushing device (4) is changeable such that the housing (3), the main frame (1) and the pushing device (4) can be easily connected to one another for orientating the trend of DIY.

Figure 9:
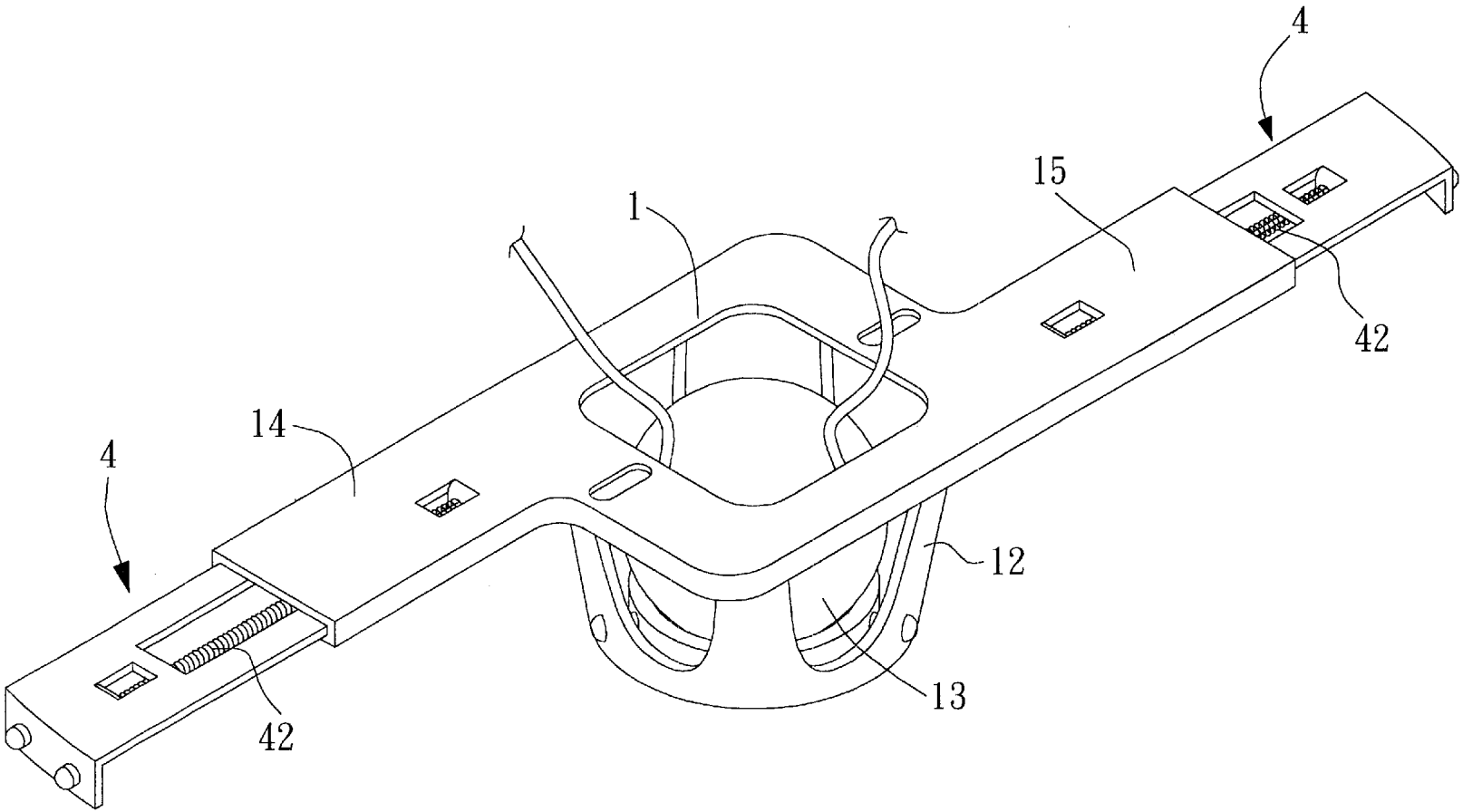
FIG. 9 is a perspective view of a second embodiment of the bracket of the suspension assembly in accordance with the present invention.
Figure 10:
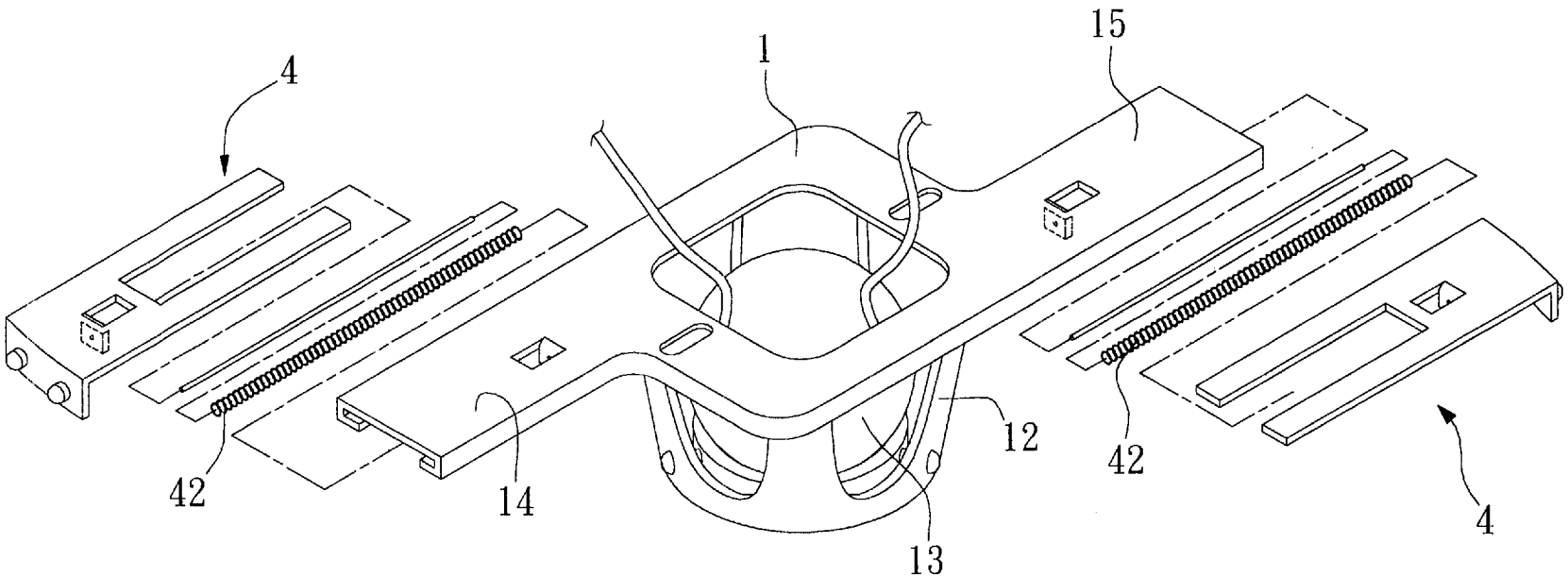
FIG. 10 is an exploded perspective view of the bracket in FIG. 9.
Figure 11:
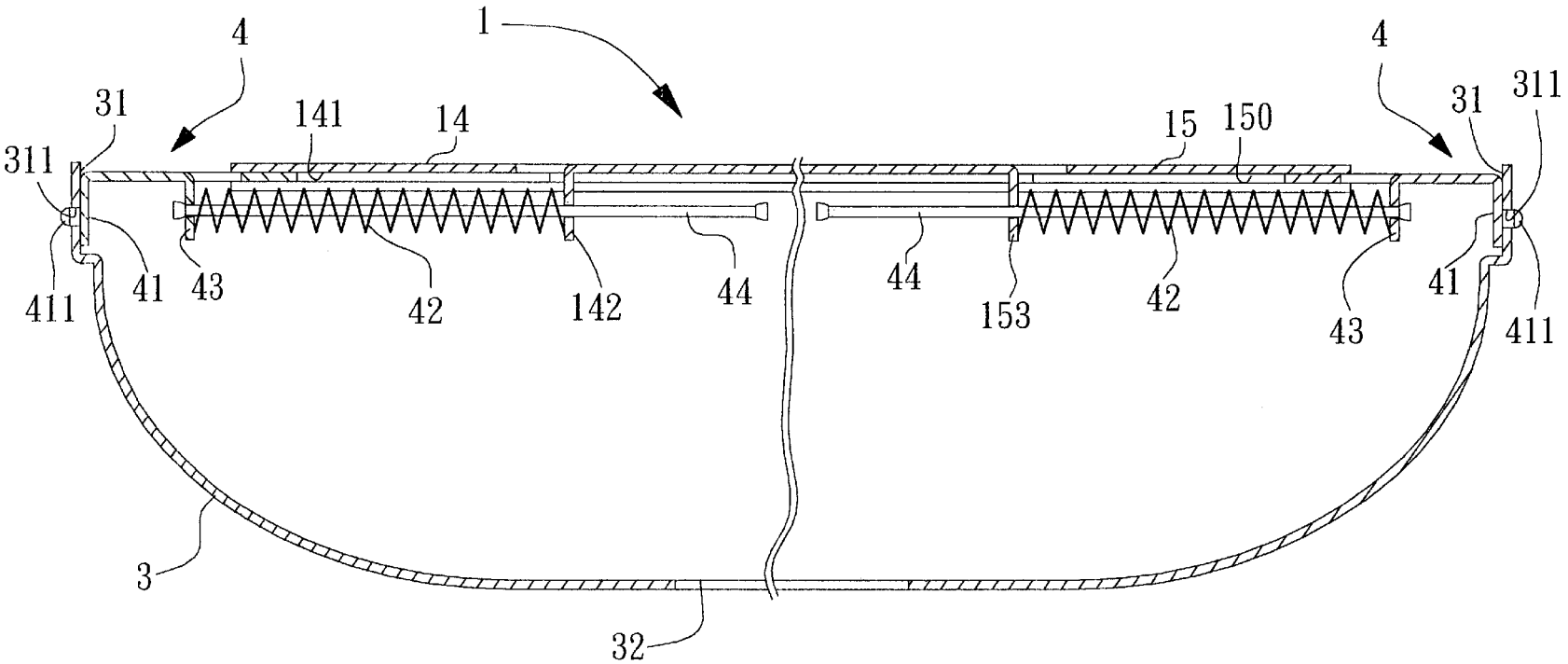
FIG. 11 is a schematic side plan view of the suspension assembly in FIG. 9.
Figure 12:
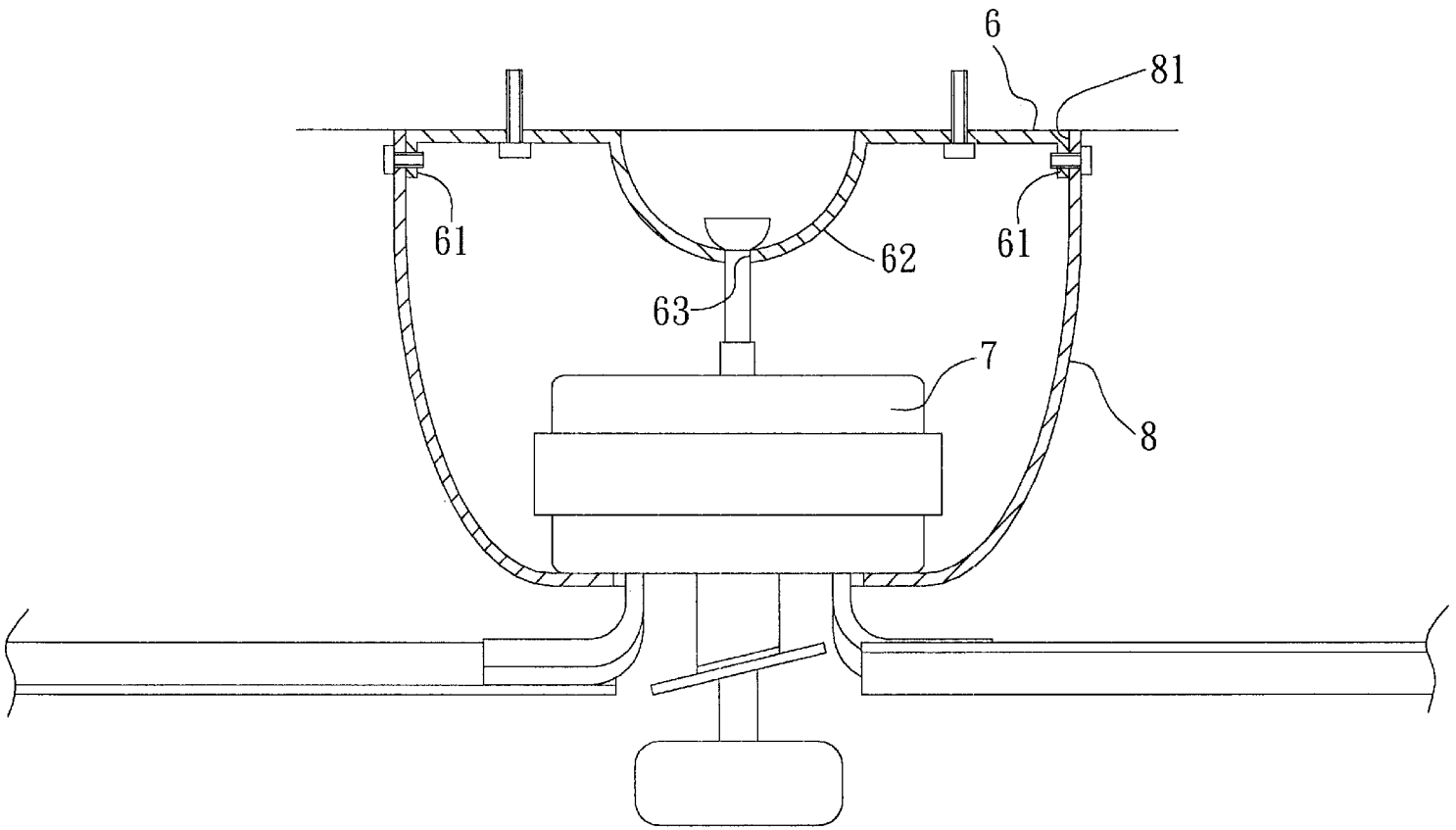
FIG. 12 PRIOR ART
FIG. 12 is a schematic side plan view of a conventional suspension assembly for a ceiling fan in accordance with the prior art.
Figure 13:
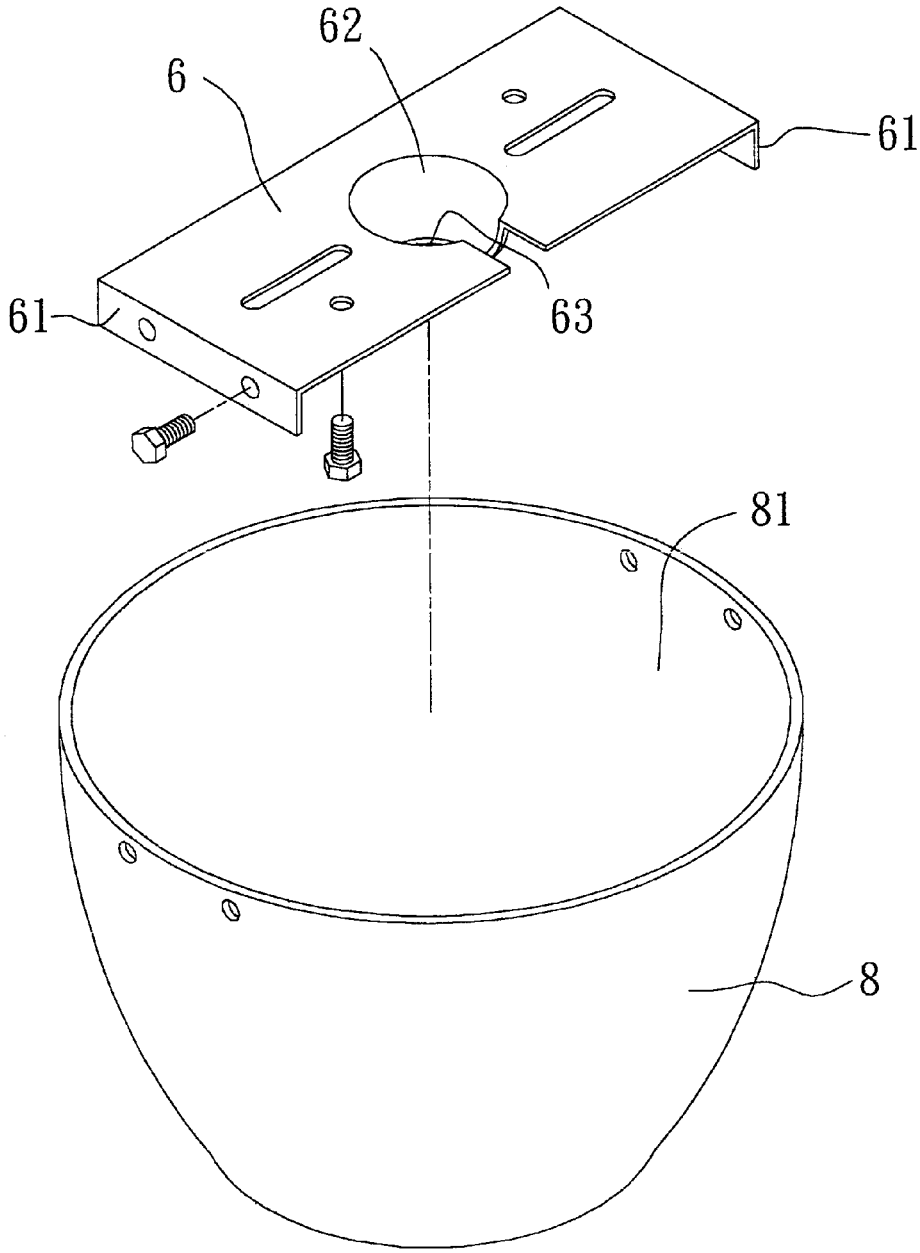
FIG. 13 PRIOR ART
FIG. 13 is an exploded perspective view of the suspension assembly in FIG. 12.

With reference to FIGS. 9, 10 and 11 those show a second embodiment of the suspension assembly for a ceiling fan in accordance with the present invention. In this embodiment, the first wing (14) and the second wing (15) each has a sliding groove (141, 150) longitudinally defined therein. The second wing (15) has a stopper (153) extending therefrom and into the sliding groove (150) in the second wing (15). A pushing device (4) is partially and slidably received in the sliding groove (141, 150) of each of first wing (14) and the second wing (15). The structure and the functions of the pushing device (4) of the second embodiment is the same as the above embodiment. The second embodiment of the present invention not only overcomes the manufacturing error of the housing (3) but also is suitable to the housing (3) that has various standards. Consequently, the using scope of the suspension assembly for a ceiling fan is wider than that of the conventional suspension assembly for a ceiling fan.

Although the invention has been explained in relation to its preferred embodiment, it is to be understood that many other possible modifications and variations can be made without departing from the spirit and scope of the invention as hereinafter claimed.

What is claimed is:

1. A fixing assembly for a ceiling fan comprising:

a main frame adapted to be secured on the ceiling and including a bracket downward extending from the main frame, the bracket adapted to hold a motor of the ceiling fan in place;

a housing connected to the main frame and adapted to cover the motor of the ceiling fan;

at least one pushing device partially and slidably received in one end of the main frame to push an inner periphery of the housing for holding the housing in place.

2. The fixing assembly as claimed in claim 1, wherein:

the housing has a skirt extending therefrom and multiple through holes is defined in the skirt of the housing;

the main frame includes:

a first wing and a second wing respectively horizontally extending from the main frame, the first wing and the second wing being opposite to each other;

a sliding groove longitudinally defined in the first wing of the main frame;

a tongue extending from a free end of the second wing and facing the skirt of the housing; and at least one stub extending from the tongue and received in a corresponding one of the through holes in the skirt of the housing; and the pushing device includes:

a plate having a first end reciprocally slidably received in the sliding groove in the first wing of the main frame, and a second end with a tongue extending from the plate and facing the skirt of the housing;

at least one stub extending from the tongue of the plate of the pushing device and received in a corresponding one of the through holes in the skirt of the housing to hold the housing in place; and a resilient member mounted between the plate of the pushing device and the main frame to provide a restitution force to the plate of the pushing device.

3. The suspension assembly as claimed in claim 2, wherein:

the first wing of the main frame has a stopper extending therefrom and into the sliding groove; and the pushing device has a stopper extending from the plate and aligning with the stopper of the first wing, and a stick movably mounted on the stoppers of the first wing and the plate, the stick extending through the resilient member to prevent the resilient from becoming deformed when being compressed, the resilient having two opposite ends respectively abutting the stoppers of the first wing and the plate.

4. The suspension assembly as claimed in claim 3, wherein the resilient is a spring.

5. The fixing assembly as claimed in claim 1, wherein:

the housing has a skirt extending therefrom and multiple through holes is defined in the skirt of the housing; and the main frame includes:

a first wing and a second wing respectively horizontally extending from the main frame, the first wing and the second wing being opposite to each other; and a sliding groove longitudinally defined in each of the first wing and the second wing of the main frame.

6. The fixing assembly as claimed in claim 5 comprises two pushing devices respectively partially and slidably received in a corresponding one of the sliding grooves of the first wing and the second wing, each pushing including:

a plate having a first end reciprocally slidably received in each of the sliding grooves in the first wing and the second wing of the main frame, and a second end with a tongue extending from the plate and facing the skirt of the housing;

at least one stub extending from the tongue of the plate of the pushing device and received in a corresponding one of the through holes in the skirt of the housing to hold the housing in place; and a resilient member mounted between the plate of the pushing device and the main frame to provide a restitution force to the plate of the pushing device.

7. The suspension assembly as claimed in claim 6, wherein:

the first wind of the main frame has a stopper extending therefrom and into the sliding groove in the first wing;

the second wing of the main frame has a stopper extending therefrom and into the sliding groove in the second wing; and each pushing device has a stopper extending from the plate and aligning with a corresponding one of the stoppers of the first wing and the second wing, and a stick movably mounted on the stoppers of the first wing and the plate partially received in the first wing/the second wing and the plate partially received in the second wing, the stick extending through the resilient member to prevent the resilient from becoming deformed when being compressed, the resilient having two opposite ends respectively abutting the stoppers of the first wing and the plate partially received in the first wing/the second wing and the plate partially received in the second wing.

8. The suspension assembly as claimed in claim 7, wherein the resilient member of each of the pushing device is a spring.

* * * * *